US010690324B2

(12) United States Patent
Dubuc et al.

(10) Patent No.: US 10,690,324 B2
(45) Date of Patent: Jun. 23, 2020

(54) APPARATUS FOR MOUNTING A LUMINAIRE ON A SUPPORT

(71) Applicant: Current Lighting Solutions, LLC, East Cleveland, OH (US)

(72) Inventors: Eden Dubuc, Lachine (CA); Robert David Spivock, Lachine (CA); Justin Rioux, Lachine (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 63 days.

(21) Appl. No.: 15/343,822

(22) Filed: Nov. 4, 2016

(65) Prior Publication Data

US 2017/0276333 A1 Sep. 28, 2017

Related U.S. Application Data

(60) Provisional application No. 62/312,047, filed on Mar. 23, 2016.

(51) Int. Cl.
*F21V 21/008* (2006.01)
*F21V 15/015* (2006.01)
(Continued)

(52) U.S. Cl.
CPC ..... *F21V 21/008* (2013.01); *F21S 8/068* (2013.01); *F21V 15/015* (2013.01);
(Continued)

(58) Field of Classification Search
CPC .... F21V 21/008; F21V 15/015; F21V 21/088; F21V 21/34; F21V 23/001;
(Continued)

(56) References Cited

U.S. PATENT DOCUMENTS 4,841,420 A 6/1989 Baggio et al.
5,282,600 A 2/1994 Weiss et al.
(Continued)

FOREIGN PATENT DOCUMENTS

DE 27 48 606 A1 5/1979
EP 2 163 815 A2 3/2010
(Continued)

OTHER PUBLICATIONS

"LX-400 Accessories," Retrieved from the Internet URL: http://www.wolf-safety.co.uk/accessories/lx-400-accessories, on Jul. 18, 2017, pp. 1-5.

(Continued)

*Primary Examiner* — Y M. Quach Lee
(74) *Attorney, Agent, or Firm* — Buckley, Maschoff & Talwalkar LLC

(57) ABSTRACT

There is provided an apparatus for mounting a luminaire on a support. For example, there is provided a mechanism that includes a plate adapted to couple with an end of a luminaire. The plate includes a support member adapted to mate with the support. The mechanism further includes a tensioning member adapted to couple with the support member to secure the support in a channel region of the support member.

11 Claims, 8 Drawing Sheets

(51) Int. Cl.

| | |
|---|---|
| ***F21S 8/06*** | (2006.01) |
| ***F21V 21/088*** | (2006.01) |
| ***F21V 23/00*** | (2015.01) |
| *F21V 21/34* | (2006.01) |

(52) U.S. Cl.
CPC ..... *F21V 21/088* (2013.01); *F21V 23/001* (2013.01); *F21V 21/34* (2013.01)

(58) Field of Classification Search
CPC ..... F21V 21/0832; F21V 21/38; F21V 27/02; F21V 27/00; F21S 8/068; F21S 8/061; F21S 8/06
See application file for complete search history.

(56) References Cited

U.S. PATENT DOCUMENTS 5,743,627 A * 4/1998 Casteel ..... F21V 15/00 362/221
6,283,618 B1 * 9/2001 Fischer et al. ..... F21S 8/06 362/375
9,057,508 B1 * 6/2015 Williams et al. ... F21V 21/0832
2011/0116254 A1 5/2011 Workman et al.
2013/0044483 A1 2/2013 Volkenand et al.
2013/0094230 A1 * 4/2013 Verfuerth ..... F21V 21/112 362/396

FOREIGN PATENT DOCUMENTS

FR 985 166 A 7/1951
FR 2 913 482 A1 9/2008
WO 98/04867 A1 2/1998
WO WO02089559 A2 11/2002

OTHER PUBLICATIONS

Extended European Search Report and Opinion issued in connection with corresponding EP Application No. 17162650.0 dated Jun. 1, 2017.

* cited by examiner

APPARATUS FOR MOUNTING A LUMINAIRE ON A SUPPORT

CROSS-REFERENCE TO RELATED APPLICATIONS

The present disclosure claims the benefit of U.S. Provisional Patent Application No. 62/312,047, filed on Mar. 23, 2016, the disclosure of which is incorporated herein in its entirety by reference.

TECHNICAL FIELD

The present disclosure relates to luminaires. More particularly, the present disclosure relates to apparatuses for mounting luminaires on supports.

BACKGROUND

In a wide variety of applications, such as in greenhouse lighting, one or more luminaires can be mounted on supports to position the luminaires over a particular area. In this arrangement, the illumination level over the area can be precisely regulated. However, assembling the luminaires on such supports may be cumbersome due to the complexity of the hardware needed for mounting. Moreover, in some instances, once mounted, the luminaires may move from their originally installed position by sliding off the supports, as typical mounting hardware do not offer adequate means for securing the luminaires on the support.

SUMMARY

There is a need to provide assemblies that allow luminaires to be easily installed on supports while allowing sturdy positioning of the luminaires on the supports. The embodiments featured herein help solve or mitigate these issues as well as other issues known in the art.

For example, some embodiments of the instant disclosure provide a method and/or an assembly for safe and quick mounting of a luminaire on a support such as a cable or a wire. The luminaire can include an end part that includes a hook-shaped member and a retention force element, such as a tensioning member. The end part prevents the release of the support from the hook-shaped member when pressure is applied to the luminaire from any given direction. Moreover, the retention force element can generate pressure and friction on the support to inhibit the sliding of the hook-shaped member on the support, thereby allowing the support to be placed in a wide variety of positions, without risking the luminaire moving away relative to its original mounted position.

One exemplary embodiment provides a mechanism for mounting a luminaire on a support. The mechanism includes a plate adapted to couple with an end of the luminaire, the plate includes a support member adapted to mate with the support. The mechanism further includes a tensioning member adapted to couple with the support member to secure the support in a channel of the support member.

Another exemplary embodiment provides a luminaire assembly including a luminaire mounted on a support. The luminaire assembly includes a mechanism for mounting the luminaire on the support. The mechanism includes a plate adapted to couple with an end of the luminaire, the plate includes a support member adapted to mate with the support. The mechanism further includes a tensioning member adapted to couple with the support member to secure the support in a channel of the support member.

Additional features, modes of operations, advantages, and other aspects of various embodiments are described below with reference to the accompanying drawings. It is noted that the present disclosure is not limited to the specific embodiments described herein. These embodiments are presented for illustrative purposes. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Figure 1:
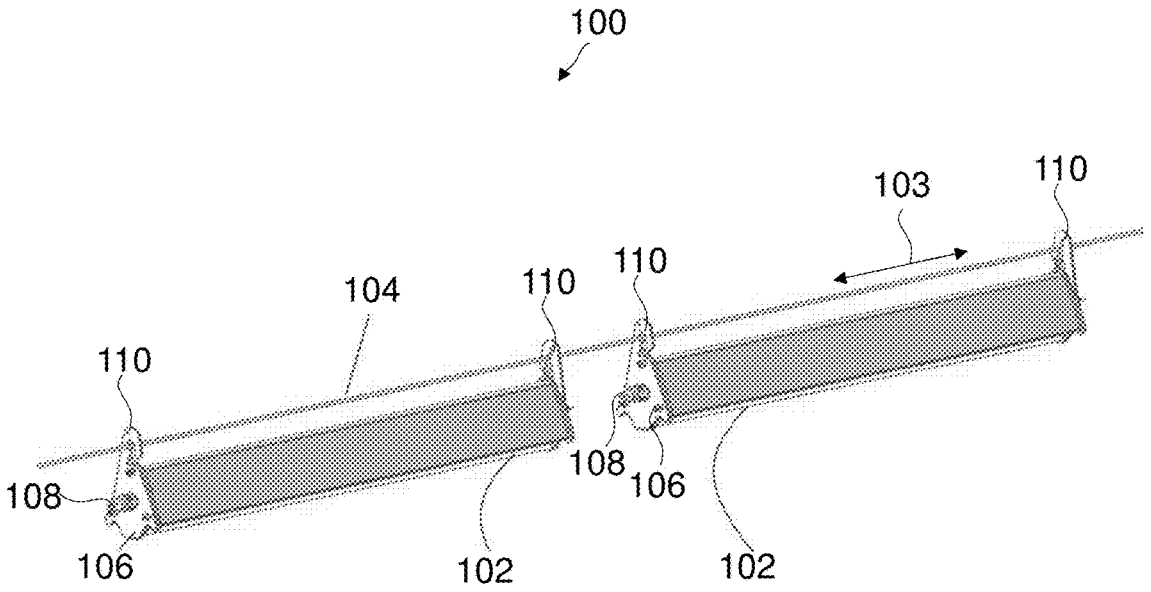
FIG. 1 illustrates a luminaire assembly in accordance with various aspects described herein.

FIG. 1 illustrates a luminaire assembly 100 according to an embodiment. The luminaire assembly 100 includes a plurality of luminaires 102, of which each luminaire 102 is mounted on a support 104. Each luminaire 102 is mounted on the support 104 by means of a support member 106; a luminaire 102 can include more than one support member 106 with which it is mounted on the support 104.

For example, for an elongated luminaire such as the ones shown in FIG. 1, two support members 106 can be used at both ends of the elongated luminaire to mount it on the support 104. Generally, the teachings featured herein are applicable to other types of luminaires (i.e. other than elongated luminaires), and depending on the shape of a specified luminaire, one or more support members 106 can be used to mount the specified luminaire on the support 104.

Figure 2:
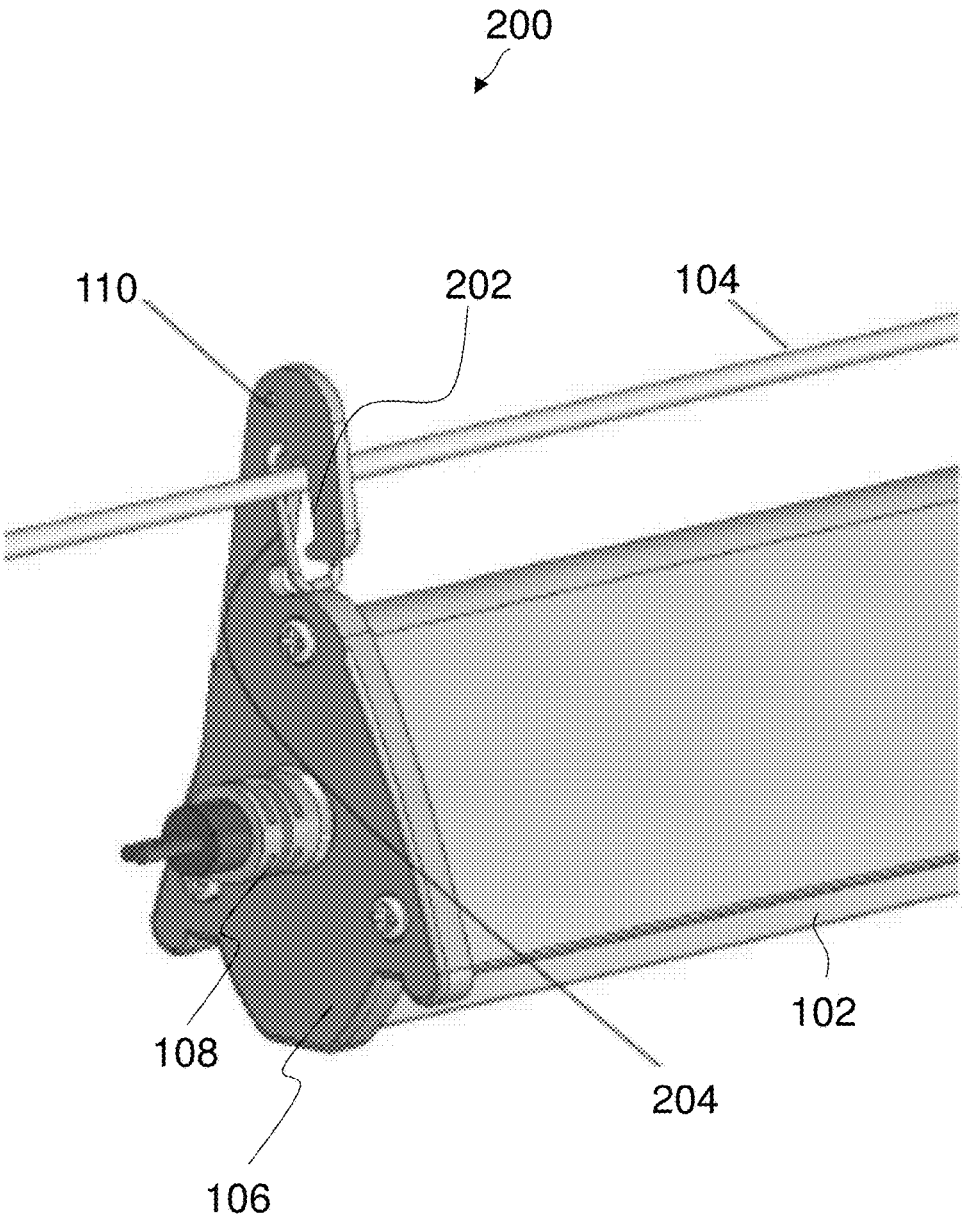
FIG. 2 shows a close-up view of a luminaire in accordance with various aspects described herein.

The support member 106 can be a plate that is mounted on an end of a luminaire 102. In some exemplary embodiments, the support member 106 includes a substantially hook-shaped portion 110 having a channel 202, as shown in FIG. 2; the support 104 is mated with support member 106 at the channel 202 and secured by a tensioning member, as shall be described in greater detail below.

Without loss of generality, the support member 106 can be a plastic part, or it can be made of metal. Moreover, it can be modular, i.e. it can be removably attached to an end plate of the luminaire 102, or it can be the end plate itself. Stated otherwise, the support member 106 can be a modular piece, or it can be a modular piece; in either case, it can be fabricated through an additive manufacturing process, for example.

In some embodiments, the support member 106 can include an interface for coupling it to the end of the luminaire 102. For example, the support member 106 can include one or more holes, which can be threaded. These holes can be made to overlap with corresponding holes on the end of the luminaire 102, and the support member 106 can thus be fastened on the luminaire 102 using screws placed in the threaded holes.

The support member 106 can further include a port 108 that is configured to let wiring or cabling pass through. The wiring can be electrical. For example, it can be used to power and/or control circuits and/or light sources included within the body of the luminaire 102. Generally, the wiring is used to provide a desired functionality to the luminaire 102.

The support 104 can be a cable or a wire on which the one or more luminaires 102 is mounted. Further, the support 104 can extend in a direction 103, which can be substantially horizontal. However, as shall be described below, because the embodiments provide means to secure the luminaires 102 on the support 104, the support 104 need not be substantially horizontal, i.e. it can also be inclined, without risking the luminaires 102 sliding away from their initial positions, as they are locked securely in place.

FIG. 2 illustrates a close-up view 200 of one of the luminaires 102. As previously mentioned, the support member 106 includes a substantially hook-shaped portion 110 that includes a channel 202 shaped to receive (or to mate with) the support 104. A tensioning member 204 secures the support 104 in the channel 202. In other words, the tensioning member 204 provides a restraint for the support 104 by generating a force (e.g. friction) to hold the support 104 in the channel 202. In some embodiments, the tensioning member 204 can be a spring. In yet other embodiments, the tensioning member 204 can be a bent spring wire.

Figure 3:
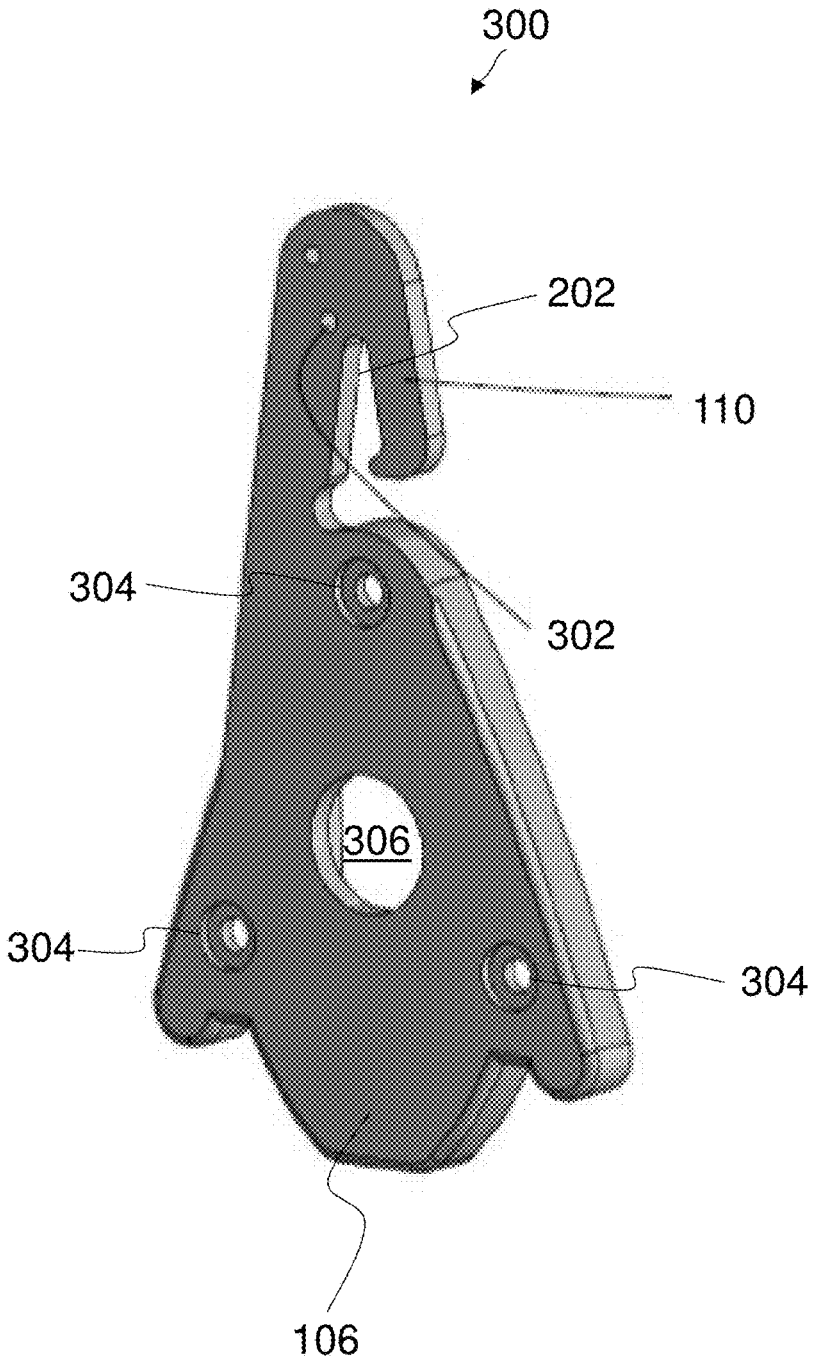
FIG. 3 shows a close-up view of a support member in accordance with various aspects described herein.
Figure 4:
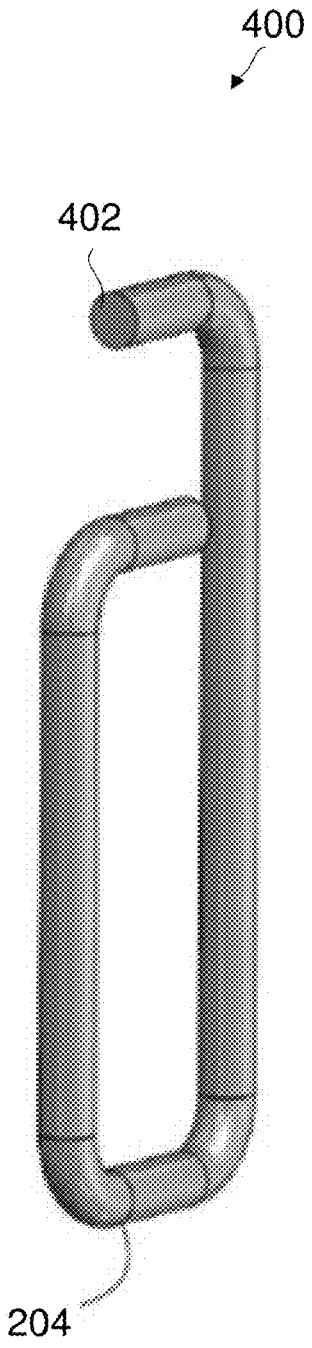
FIG. 4 illustrates a close-up view of a tensioning member in accordance with various aspects described herein.

FIG. 3 illustrates a close-up view 300 of the support member 106. In the substantially hook-shaped portion 110, the channel 202 can be appropriately sized to accommodate the width of the support 104. Further, to secure the support 104 in the channel 202, a hole 302 is provided in which a portion 402 of the tensioning member 204 can be inserted; as can be seen in reference to FIG. 2 and the close-up view 400 of the tensioning member 204 shown in FIG. 4.

The portion 402 of the tensioning member 204 can be inserted in the hole 302 or snaked through it in order to provide a pivot point against which the tensioning member 204 can be actuated to secure the support 104 in the channel. In some embodiments, there can be more than one hole 302 on the substantially hook-shaped portion 110, thus providing a reconfigurable mechanism for adjusting the tensioning member 204 to accommodate supports of different sizes (e.g. of different diameters).

The support member 106 further includes a plurality of holes 304, which can be part of an interface that is configured to couple the support member 106 with the end of the luminaire 102, as shown in FIG. 2. The holes 304 can be threaded and screws inserted therein to secure the support member 106 onto the end of the luminaire 102. The support member 106 can further include a hole 306 that is sized appropriately to secure the port 108, as shown in FIGS. 1 and 2.

Figure 5:
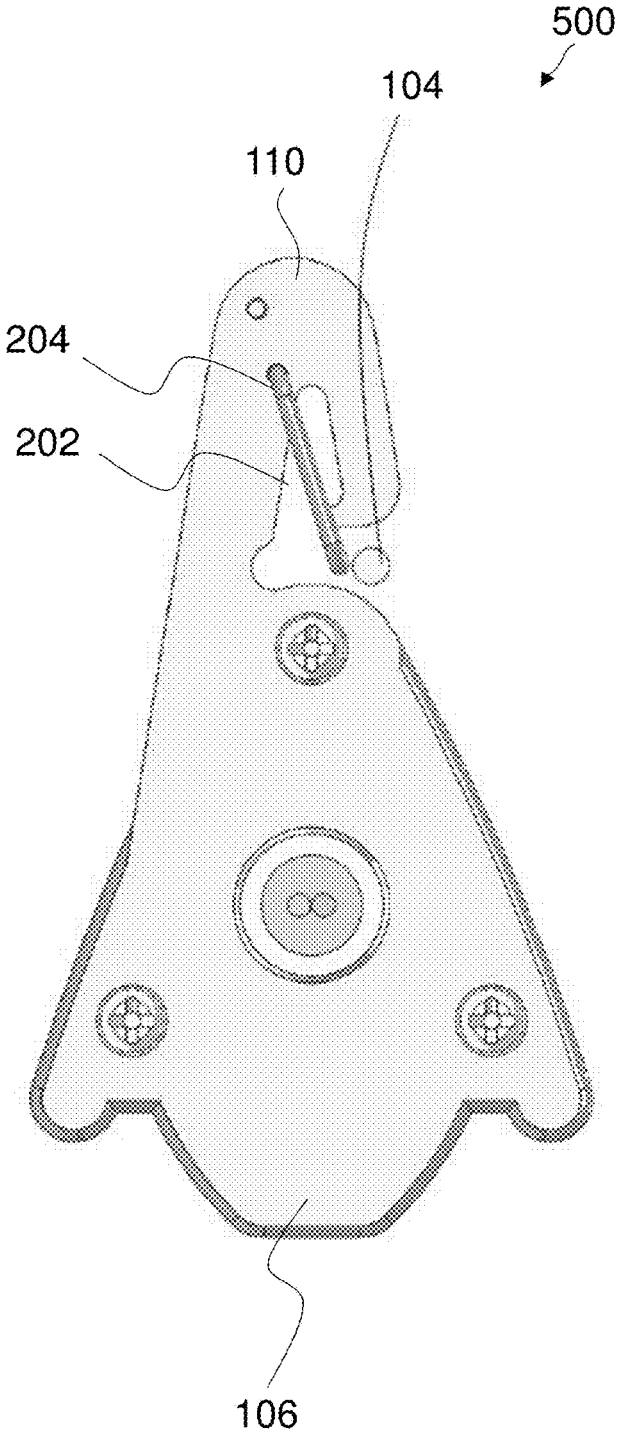
FIG. 5 illustrates a cross-sectional view of a luminaire assembly in accordance with various aspects described herein.

Having set forth various embodiments, various positions of the support member 106 and the tensioning member 204 during mounting are described with respect to the close-up views 500, 600, 700, and 800, shown in FIGS. 5, 6, 7, and 8, respectively. Specifically, FIGS. 5-8 illustrate a sequence of how the support 104 (shown end-on) may become seated in the support member 106 of a luminaire 102, as illustrated in FIG. 1. In FIG. 5, a technician installing the luminaire 102 on the support 102 may begin by approaching the substantially hook-shaped portion 110 of the support member 106 to the support 104.

Figure 6:
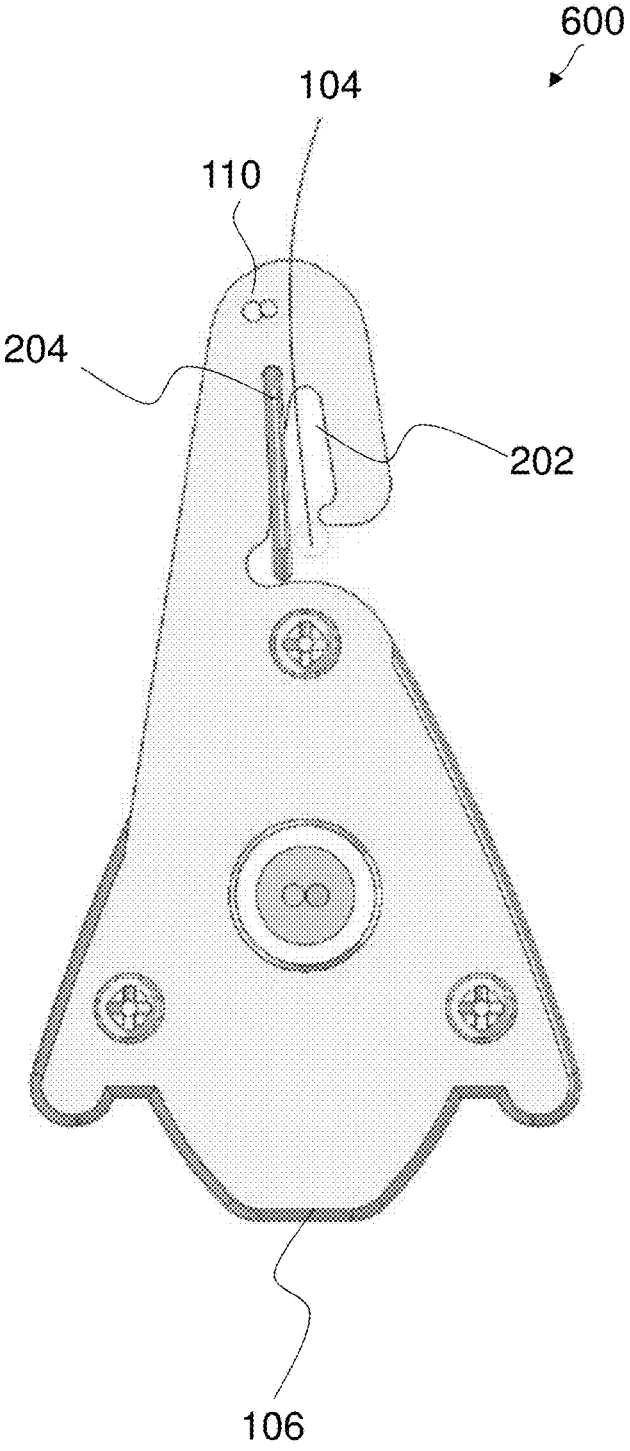
FIG. 6 illustrates a cross-sectional view of a luminaire assembly in accordance with various aspects described herein
Figure 7:
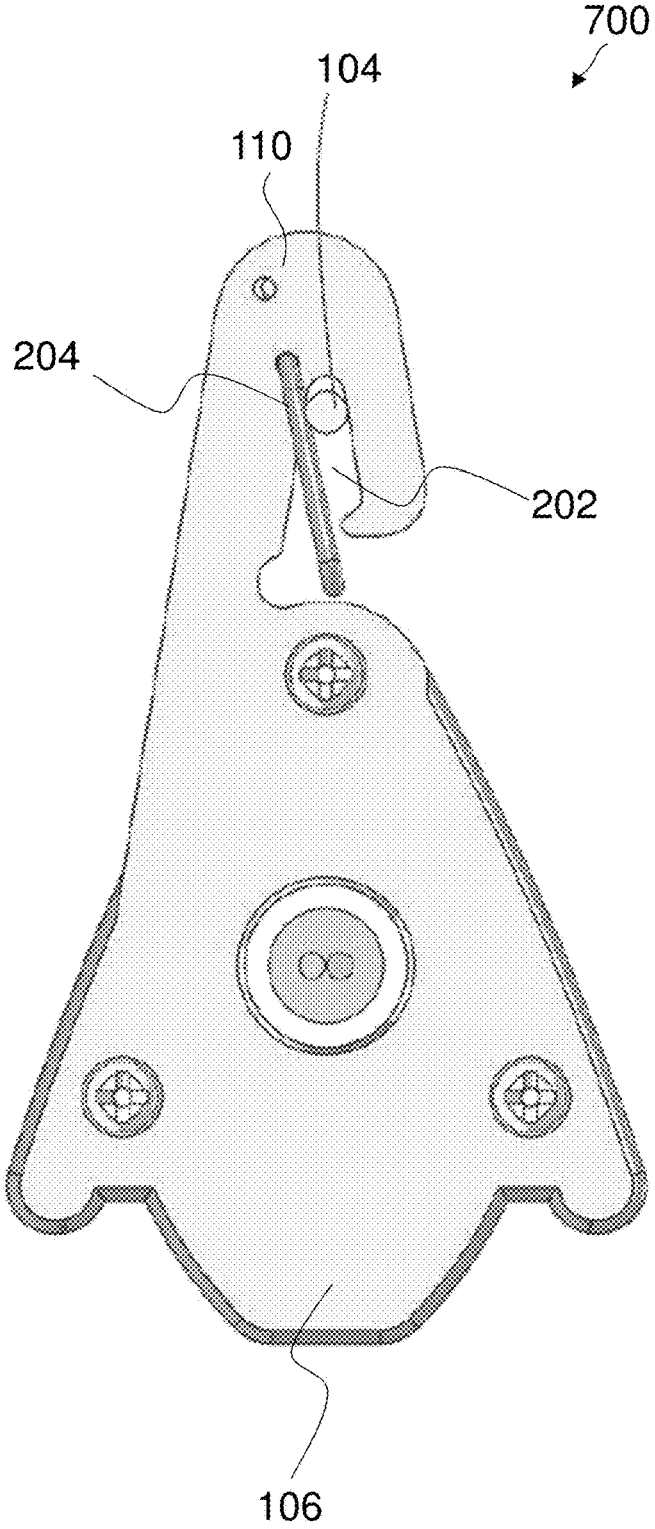
FIG. 7 illustrates a cross-sectional view of a luminaire assembly in accordance with various aspects described herein.
Figure 8:
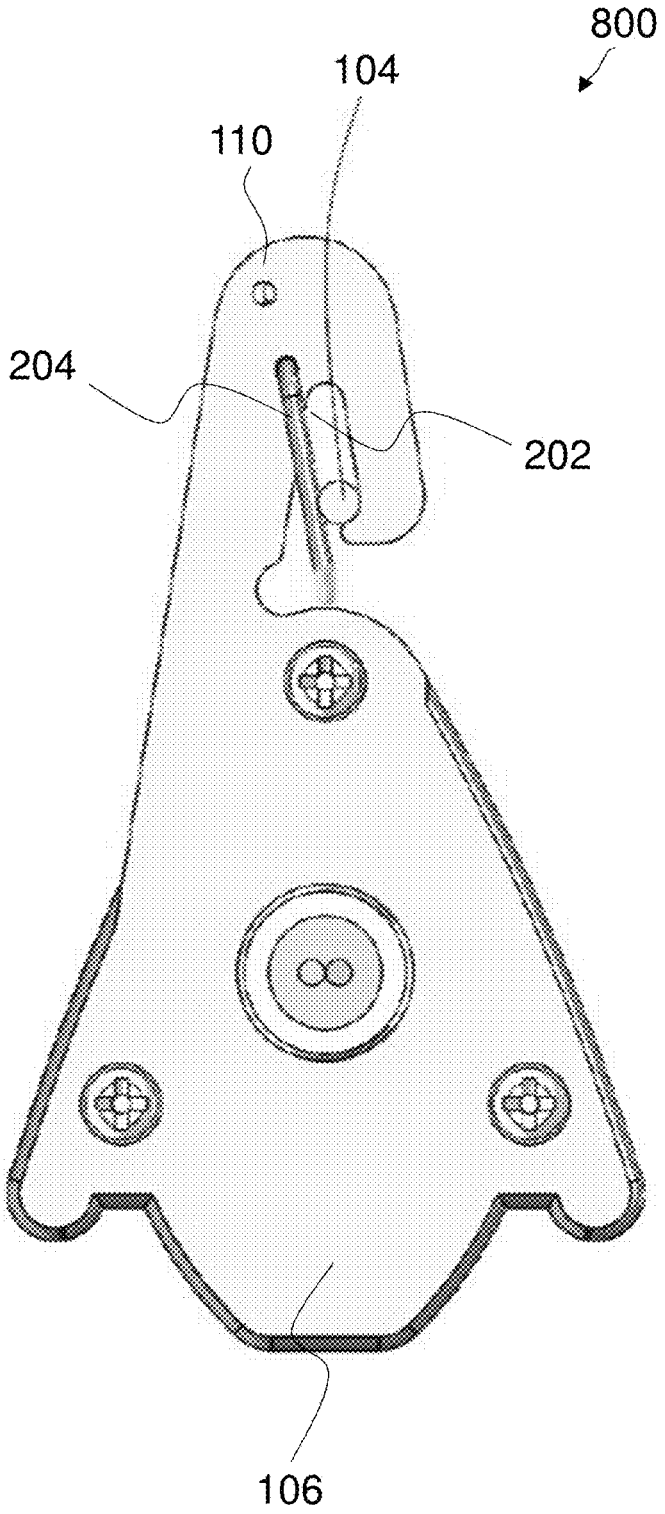
FIG. 8 illustrates a cross-sectional view of a luminaire assembly in accordance with various aspects described herein.

As shown in FIG. 6, by applying pressure on the support member 106 onto the support 104, the tensioning member 204 begins to move so that the support 104 approaches the channel 202 of the substantially hook-shaped portion 110. In FIG. 7, the support 104 is shown at the top of the channel 202; this is the position of the support 104 when the luminaire 102 is naturally suspended on the support 104 under the force of gravity. FIG. 8, shows an alternative position of the support 104 that illustrates how the support 104 may be prevented from sliding out of the channel 202 by a combination of the tension provided by the tensioning member 204, and the most curled portion of the substantially hook-shaped portion 110.

As such, in the embodiments, the application of a uniaxial force would not be able to dislodge the support 104 from the channel 202. Moreover, detaching the luminaire 102 can be achieved by applying pressure to the luminaire and twisting it to unlock the support cable from the substantially hook-shaped member 110.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A luminaire assembly comprising a luminaire mounted on a support, wherein the support is one of a cable and a wire, the luminaire assembly comprising:

a mechanism configured for mounting the luminaire on the cable or wire, wherein the mechanism includes:

a plate adapted to couple with an end of the luminaire, the plate including a port configured for passage of electrical wiring or electrical cabling, the plate itself including a support member adapted to receive or mate with the cable or wire, wherein the support member includes a substantially hook-shaped portion defining a channel region to receive or mate with the cable or wire; and a tensioning member adapted to couple with the support member to secure the cable or wire in the channel region of the support member, the tensioning member configured to generate a force upon the cable or wire to inhibit sliding of the substantially hook-shaped portion on the cable or wire;

wherein the luminaire is an elongated luminaire and wherein the mechanism is used at two ends of the elongated luminaire to mount the elongated luminaire on the cable or wire.

2. The luminaire assembly of claim 1, wherein the plate includes an interface configured for coupling with the end of the luminaire.

3. The luminaire assembly of claim 2, wherein the interface includes a threaded hole.

4. The luminaire assembly of claim 1, wherein the tensioning member includes a spring.

5. The luminaire assembly of claim 4, wherein the spring is a bent spring wire.

6. The luminaire assembly of claim 1, wherein the plate includes a hole configured for receiving a portion of the tensioning member.

7. A luminaire assembly comprising a luminaire mounted on one of a cable and a wire, the luminaire assembly comprising:

a mechanism configured for mounting the luminaire on the cable or wire, wherein the mechanism includes:

an end part at an end of the luminaire adapted to receive or mate with the cable or wire, wherein the end part includes a substantially hook-shaped portion defining a channel region to receive or mate with the cable or wire; and a tensioning member adapted to couple with the end part to secure the cable or wire in the channel region of the substantially hook-shaped portion, the tensioning member configured to generate a force upon the cable or wire to inhibit sliding of the substantially hook-shaped portion on the cable or wire;

wherein the luminaire is an elongated luminaire and wherein the mechanism is used at two ends of the elongated luminaire to mount the elongated luminaire on the cable or wire.

8. The luminaire assembly of claim 7, wherein the end part includes a port configured for passage of electrical wiring or electrical cabling.

9. The luminaire assembly of claim 7, wherein the end part is a plate adapted to couple with the end of the luminaire.

10. The luminaire assembly of claim 7, wherein the tensioning member includes a spring.

11. The luminaire assembly of claim 10, wherein the spring is a bent spring wire.

* * * * *